United States Patent [19]

Achelpohl et al.

[11] 4,114,520

[45] Sep. 19, 1978

[54] APPARATUS FOR MAKING BAGS FROM A CONTINUOUSLY FED THERMOPLASTIC TUBULAR WEB OF FILM

[75] Inventors: Fritz Achelpohl; Friedhelm Brinkmeier, both of Lengerich, Fed. Rep. of Germany

[73] Assignee: Windmoller & Holscher, Lengerich, Fed. Rep. of Germany

[21] Appl. No.: 785,697

[22] Filed: Apr. 7, 1977

[30] Foreign Application Priority Data

Apr. 14, 1976 [DE] Fed. Rep. of Germany ..... 2616574

[51] Int. Cl.[2] ..... B31B 23/60

[52] U.S. Cl. ..... 93/33 H; 156/515; 156/583

[58] Field of Search ..... 93/33 H, 33 R, 35 R, 93/DIG. 1, 19; 53/DIG. 2; 156/515, 583

[56] References Cited

U.S. PATENT DOCUMENTS

| | | | |
|---|---|---|---|
| 3,703,590 | 11/1972 | Holler et al. | 156/583 |
| 3,762,282 | 10/1973 | van der Meulen | 93/33 H X |
| 3,833,446 | 9/1974 | Class | 93/33 H X |
| 3,896,709 | 7/1975 | Brinkmeier | 93/33 R X |
| 3,954,371 | 5/1976 | Hutt et al. | 93/33 H X |
| 4,023,470 | 5/1977 | van der Meulen | 93/33 H X |

FOREIGN PATENT DOCUMENTS

| | | | |
|---|---|---|---|
| 2,427,068 | 12/1975 | Fed. Rep. of Germany | 93/33 H |

*Primary Examiner*—James F. Coan
*Attorney, Agent, or Firm*—Fleit & Jacobson

[57] ABSTRACT

In an apparatus for making bags from a continuously fed flattened thermoplastic tubular or semi-tubular web of film, severing means for cutting the web into sections co-operate with a first welding cylinder for performing a welding operation on each section with the aid of welding tongs, the web sections being held to the welding cylinder by means of belts which partially envelop the cylinder, and a second welding cylinder is provided downstream of the first cylinder, the web sections being transferred to the second cylinder for the purpose of having a further welding operation performed on them.

5 Claims, 5 Drawing Figures

APPARATUS FOR MAKING BAGS FROM A CONTINUOUSLY FED THERMOPLASTIC TUBULAR WEB OF FILM

The invention relates to an apparatus for making bags from a continuously fed thermoplastic tubular or semi-tubular web of film, comprising transverse severing means severing sections from the web of film, a transverse welding cylinder provided with controlled welding tongs, and belts which partially envelop the transverse welding cylinder and hold the tube sections thereto.

DT-PS 1 070 487 discloses an apparatus for making bags which are open at one side from a continuously fed thermoplastic web of tubular film, wherein sections severed from the web of tubular film run on a transverse welding cylinder that is partially enveloped by a pressure belt, the welding tongs of the welding cylinder being uniformly distributed over the periphery and clamping the film section at its trailing end. The bags provided with the base seams are then taken from the transverse welding cylinder by a cylinder equipped with gripping tongs which engage the bags at their open leading end. The gripping tong cylinder then deposits the bags on a table provided with conveyor belts that take them away.

In an apparatus of the aforementioned kind known from DT-OS 2 207 043, one-sidedly open bags provided only with base seams can likewise be made from a web of tubular film, the bags being withdrawn from the transverse welding cylinder by a folding tong cylinder which provides the bags with a transverse fold.

It is the problem of the present invention to provide an apparatus with which one can make bags that are open at one side as well as bags that are closed at both ends from, for example, a tubular film that is provided with side pleats so as to produce so-called singlet bags.

According to the invention, this problem is solved in an apparatus of the aforementioned kind in that the transverse welding cylinder is followed by a further transverse welding cylinder of which the welding tongs take over the film sections at their free ends which are not clamped to the first transverse welding cylinder. By means of the apparatus of the invention, the tube sections severed from the continuously fed web of tubular film are taken by the first transverse welding cylinder and provided with transverse welding seams at their trailing ends that are engaged by the welding tongs. After about one half to three quarters of one revolution of the first transverse welding cylinder, the tube sections are transferred to the second transverse welding cylinder of which the welding tongs engage the tube sections at their leading ends and provide same with transverse weld seams that close same completely.

However, the apparatus according to the invention can also be used to make bags that are open at one side, use being made merely of the welding tongs that provide the tube sections with transverse weld seams at their leading or trailing ends. The inoperative welding tongs may if desired be used as gripping and holding tongs, in which case only the welding current is switched off.

Bags with side pleats provided with transverse weld seams at both ends by the apparatus according to the invention can be stamped out in known manner to provide substantially rectangular cut-outs which include the inner folded edges of the side folds to form so-called singlet bags.

Finally, the apparatus according to the invention can work on a semi-tubular film to make one-sidedly open bags by producing the first side seam on the transverse welding cylinder and the second side seam on the second transverse welding cylinder. In this case, the apparatus will produce bags with side seams that are open at the top and out of which handle holes can be stamped if required.

Desirably, the surfaces of the first transverse welding cylinder are provided with air suction boxes by means of which the tube sections are located on the surface. Two air suction boxes may be provided between each two welding tongs at a spacing adjustable to correspond to the severed lengths of the film sections. By setting the suction boxes to the different lengths of section, one prevents the front region of longer tube sections from tilting towards the interior of the transverse welding cylinder, which would make the transfer to the downstream transverse welding cylinders more difficult.

Since the tube sections need be located on the transverse welding cylinder by a suction force only until they are pressed on by the enveloping belts, a control may be provided for the suction air that connects to the source of suction only those suction boxes which are located in the sector between the position where the films are applied and the start of the pressure belts.

Desirably, blow nozzles are provided beneath the cylinder surface and radially directed towards same to lift the free ends of the film sections from the first transverse welding cylinder so as to transfer them to the second transverse welding cylinder. The air blown from these blow nozzles lifts the tube section from the periphery of the transverse welding cylinder at the instant of transfer.

The severing means desirably consist of a rotary knife cylinder of which the knife acts on the peripheral surface of the transverse welding cylinder. The peripheral speed of the transverse welding cylinder may be higher than the speed of the arriving web of film so that the cut edges are drawn apart. The higher peripheral speed of the transverse welding cylinder also results in stretching of the web of film between the feed rollers for supplying same and the transverse welding cylinder, so that they come to lie on the periphery of the transverse welding cylinder without corrugations and folds and the tube sections are severed only in this smooth position.

For smoothly severing the web of film, the knife may be heated, the temperature of the knife being of the order of the welding temperature.

Printed webs of tubular film usually have spaces between the individual printed impressions. In a further embodiment of the invention, the phase position of the rotary movements of the two transverse welding cylinders is relatively adjustable to even out different print spacings of printed webs of film. To change the phase position, differential gearing or change gearing may be provided. The gearing setting the phase position may be adjustable by hand or desirably by means of an electric motor which can be controlled by a photoelement scanning the web of film.

In a further development of the invention, belt guiding means are provided between the two transverse welding cylinders for transferring the tube sections and each segment of the first transverse welding cylinder disposed between two welding tongs is divided into two regions of which the first is purely a suction air region and the second is divided by peripheral ribs into individual juxtaposed strips which can be impinged partly by suction air and partly by blown air controlled by valves. This does away with adjustment of the suction boxes holding the start of the tube section, thereby making it possible to save on machine costs.

Further advantageous embodiments of the invention are described in more detail in the subsidiary claims.

An example of the invention will now be described in more detail with reference to the drawing, in which.

Figure 1:
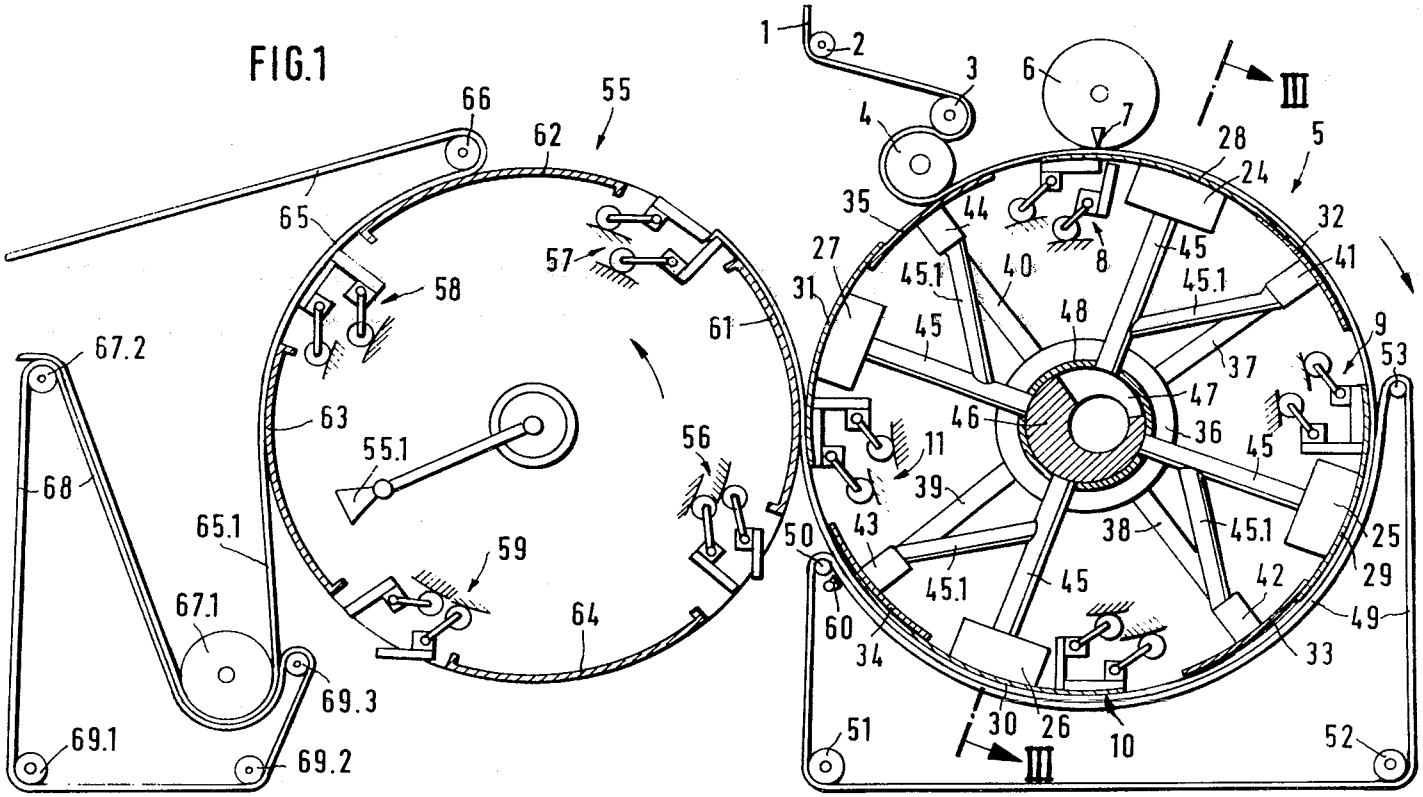
FIG. 1 is a diagrammatic side elevation of the apparatus for making bags.
Figure 2:
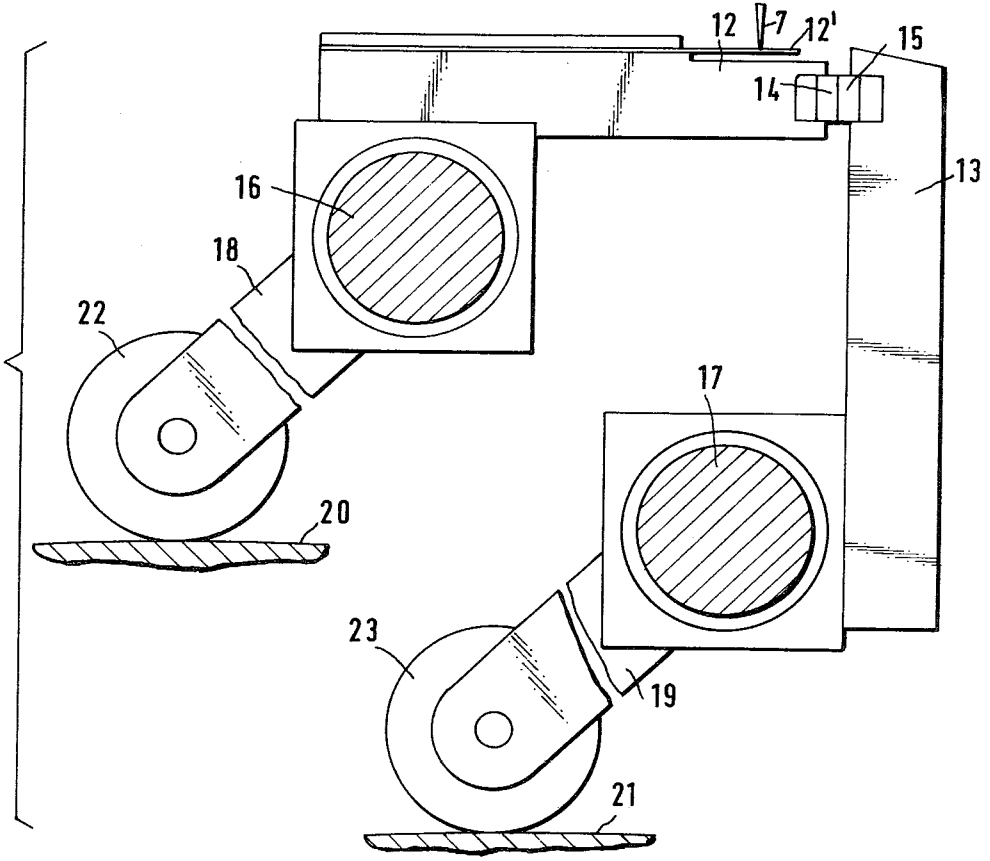
FIG. 2 is an enlarged side elevation of the welding tongs and part of the knife cylinder.
Figure 3:
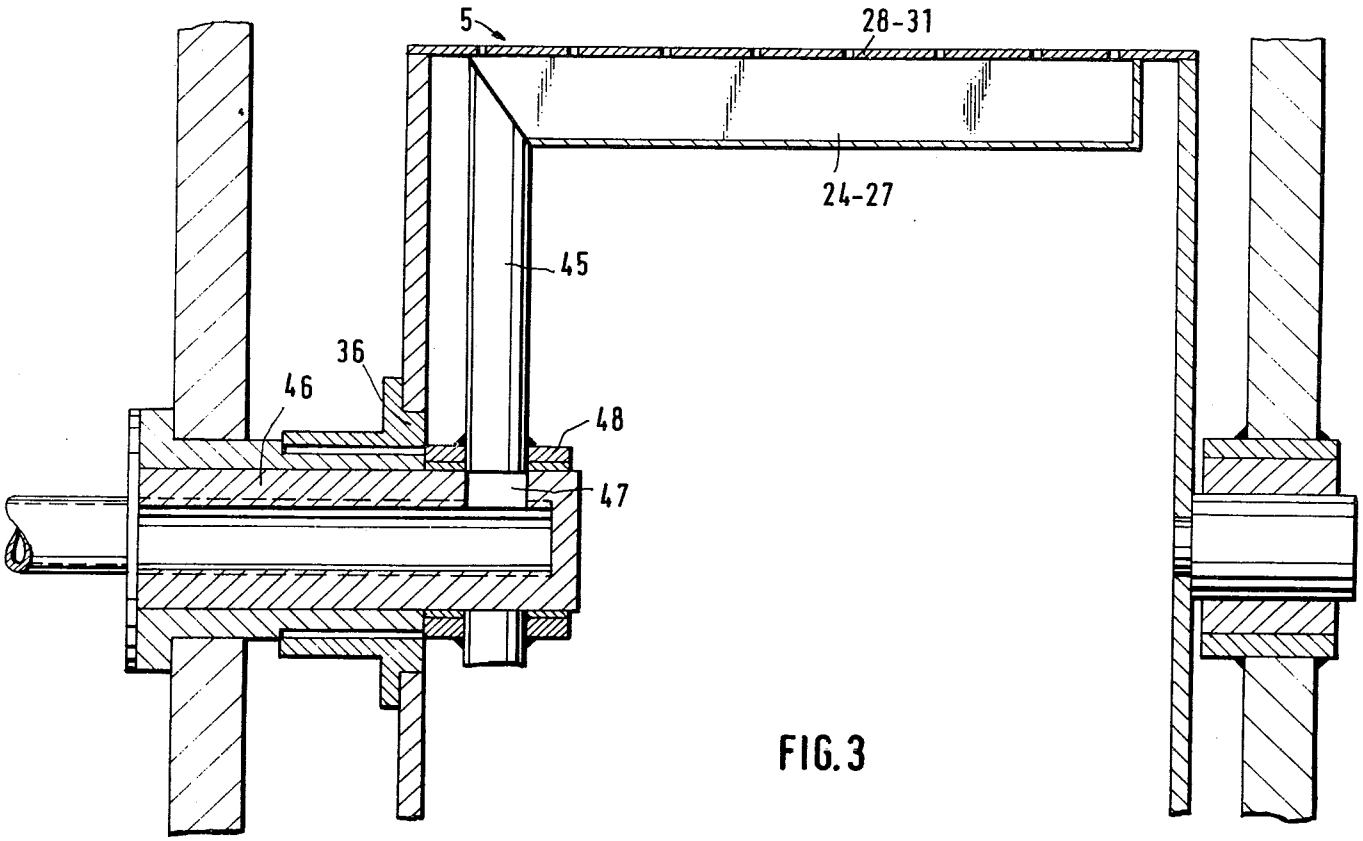
FIG. 3 is an enlarged section on the line III—III in FIG. 1.

A tube or semi-tube 1 is fed to a first transverse welding cylinder 5 over a guide roller 2 and a tension roller 3, 4, the cylinder 5 co-operating with a knife cylinder 6. The knife cylinder 6 comprises a heated cutting knife 7. At the periphery of the transverse welding cylinder 5 there are four pairs of welding tongs 8 to 11 each consisting of two tong segments 12, 13 which are both equipped with confronting welding belts 14, 15 and have a length substantially equal to the breadth of the transverse welding cylinder 5. The welding tongs 12, 13 are mounted on shafts 16, 17 secured in the cylinder 5 and are actuated by levers 18, 19 at the free ends of which there are loosely rotatable rollers 22, 23 which run on cam plates 20, 21 which are fixed with respect to the frame. On the surface facing the knife cylinder, the tong segment 12 is equipped with a leaf spring 12' against which the heated knife 7 runs. By means of the leaf spring 12', the tube material 1 passed between the transverse welding cylinder 5 and the heated knife 7 lies intimately against the knife 7 and is therefore uniformly severed across its entire width. After severing, the welding tong segments 12, 13 open on further rotation of the transverse welding cylinder 5 and the end of the tube section projecting rearwardly beyond the welding mouth drops between the two tong segments 12, 13 and is transversely welded therebetween after the tongs have closed.

Upstream of the pairs of welding tongs 8 to 11 as viewed in the direction of rotation, air suction boxes 24 to 27 are provided at the periphery of the transverse welding cylinder 5 over the width thereof, the boxes being closed towards the outside by cover plates 28 to 31 which are curved corresponding to the diameter of the transverse welding cylinder 5 and are provided with a plurality of suction holes. In front of the air suction boxes 24 to 27 there are plates 32 to 35 which are likewise curved to the radius of the transverse welding cylinder 5 and which are secured to a common bearing 36 with arms 37 to 40, the bearing being pivotable about the axis of the transverse welding cylinder 5. Connected to the plates 32 to 35 there are suction chambers 41 to 44 which suck air from the outside through holes provided in the plates 32 to 35. The chambers 24 to 27 and 41 to 44 are connected by conduits 45 or 45.1 to a control valve consisting of a sleeve 46 fixed with respect to the frame and having a control slit 47 and a sleeve 48 that turns together with the transverse welding cylinder 5. Depending on the phase position, one of the four conduits 45 is connected to a source of suction air (not shown) that is connected to the sleeve 46.

The transverse welding cylinder 5 is enveloped by a number of juxtaposed belts 49 running over guide rollers 50 to 53.

The suction boxes 41 to 44 are provided to hold the starts of the tube sections between the knife cylinder 6 and the belts 49 running onto the transverse welding cylinder 5. By turning the bearing 36 or the arms 37 to 40, they are set to the lengths of bags to be made, the cover plates 28 to 31 and the plates 32 to 35 overlapping to a greater or less extent. The control slit 47 has a length such that the tube sections are sucked to the transverse welding cylinder 5 along the sector between the knife cylinder 6 and the point where the belts 49 run onto the cylinder.

After the pairs of welding tongs 8 to 11 have been closed, welding commences and continues for about half a turn of the transverse welding cylinder 5.

A second transverse welding cylinder 55 turning in the opposite direction to the welding cylinder 5 is arranged at the transverse welding cylinder 5. It likewise comprises four pairs of welding tongs which are designated 56 to 59 and are controlled in the same way as the pairs of welding tongs of the first transverse welding cylinder 5. Their mouth is pointed towards the start of the arriving tube section and engages same at the point where the welding cylinders 5, 55 make contact with each other. In order that the start of the tube section is not withdrawn over the guide roller 50 together with the belts 49, a row of blow air nozzles 60 is arranged in front of the guide roller 50, their blowing air being turned on and off by a control device (not shown). Between the pairs of welding tongs 56 to 59, the transverse welding cylinder 55 is covered by curved and apertured cover plates 61 to 64 on which the tube section lies. The transverse welding cylinder 55 is partially enveloped by conveyor belts 65 which run over guide rollers 66 and 67.1, 67.2. The guide rollers 67.1, 67.2 are, however, also enveloped by further juxtaposed belts 68 which are guided further over guide rollers 69.1, 69.2, 69.3. Between the guide rollers 67.1, 69.3 there is formed an upwardly directed belt mouth which receives the tube sections which are withdrawn from the transverse welding cylinder 55 along the downwardly directed runs 65.1 and which are now also transversely welded at their leading ends. To ensure that they will be lifted from the cover plates 61 to 64, blow nozzles 55.1 fixed thereto are directed towards the apertured cover plates 61 to 64 and discharge controlled blown air which exert on the tube sections a radially directed outwardly acting force and drive same into the belt mouth. The tube sections are fed by the belts 65, 68 for further processing (not shown) which may comprise stamping out of the recesses in the case of singlet bags or the handle holes in the case of carrier bags, collecting same and transversely folding same.

Figure 4:
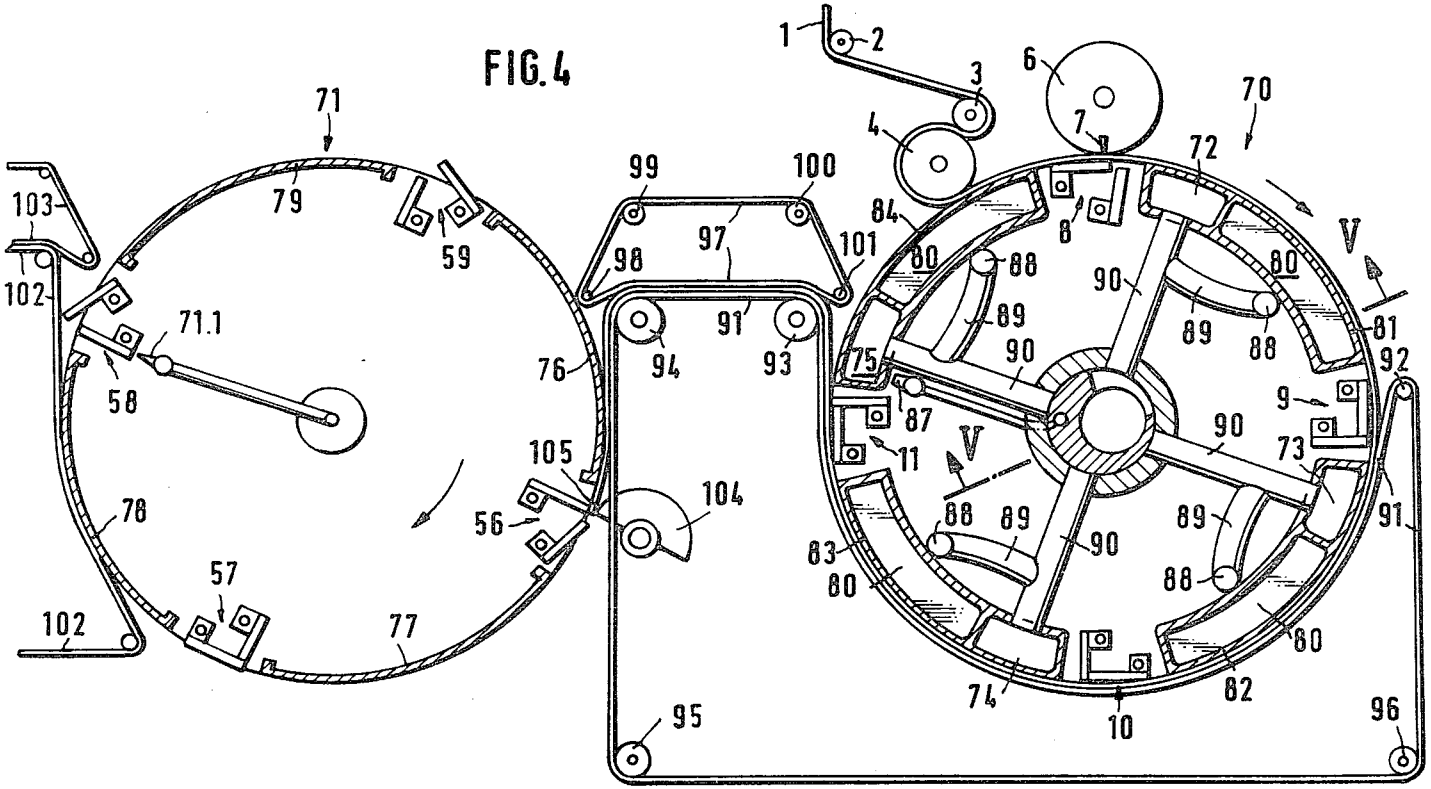
FIG. 4 is a side elevation of a further embodiment of the apparatus for making bags.
Figure 5:
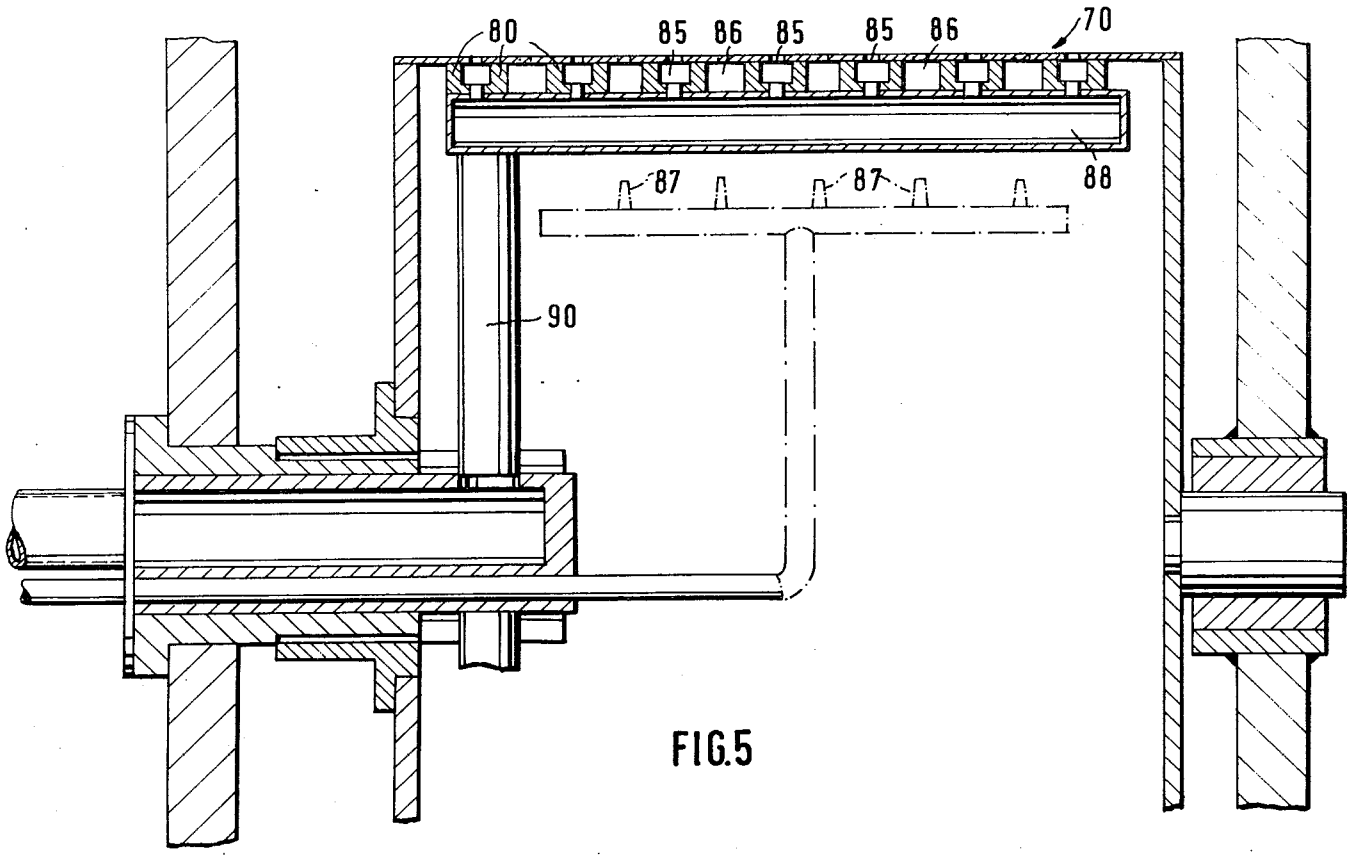
FIG. 5 is an enlarged section on the line V—V in FIG. 4.

FIG. 4 shows an apparatus with two transverse welding cylinders 70, 71 which likewise comprise pairs of welding tongs 8 to 11 or 56 to 59 and in which the suction chambers 24 to 27 with cover plates correspond to the suction chambers 72 to 75, the cover plates 61 to 64 correspond to the cover plates 76 to 79 and the blow nozzles 55.1 correspond to the blow nozzles 71.1. The air suction chambers 72 to 75 of the transverse welding cylinder 70 are adjoined by regions 81 to 84 sub-divided by circumferential ribs 80, the regions comprising strips 85 and strips 86 impinged by controlled suction air, it being possible for the strips 86 to exert forces directed radially away from the transverse welding cylinder 70 by means of controlled blown air discharged from the blow nozzles 87. The strips 85 of suction air are connected by tubes 88 and conduits 89 to conduits 90 leading to the air suction chambers 72 to 75. The suction air is controlled in the same way as for the transverse welding cylinder 5. The blown air is controlled in a manner not shown by, for example, a magnetic valve, the supply line being led through a hollow shaft that is fixed with respect to the frame.

The transverse welding cylinder 70 is enveloped by a plurality of juxtaposed belts 91 which run over guide rollers 92 to 96 and make tangential contact with the transverse welding cylinder 71. Between the guide rollers 93, 94, the tube sections are guided by further conveyor belts 97 which run over guide rollers 98 to 101 and the guide rollers 93, 94. The tube sections transversely welded at their trailing end are engaged at their leading end by the welding tongs 56 to 59 of the transverse welding cylinder 71 and are transversely welded. To facilitate introduction of the start of the tube sections, an introducer 104 is provided which is made in several parts so that it can engage between the belts 91 and which possesses an introducing edge 105 with which it pushes the start of the tube sections between the opened welding tongs 56 - 59. The transverse welding cylinder 71 is partly enveloped by a number of juxtaposed belts 102. After completed welding, the welding tongs 56 to 59 open and the air blown from the blow nozzles 71.1 place the tube sections against the upwardly directed runs of the belts 102 which, together with belts 103, form a double belt guide by which the tube sections are fed towards further web treatment.

We claim:

1. Apparatus adapted for connection to a source of suction air for making bags from a continuously fed thermoplastic tubular or semi-tubular web of film comprising:

a first transverse welding cylinder having a surface for receiving a tubular web of film;

means for rotating said first transverse welding cylinder so that the peripheral speed of its surface is higher than the speed of the continuously fed web of film;

transverse severing means for severing tubular sections having first and second ends from the received tubular web of film, said transverse severing means comprising a rotary knife cylinder positioned adjacent the surface of said first transverse welding cylinder and having a heated knife acting on the surface of said first transverse welding cylinder;

first controlled welding tongs carried by said first welding cylinder for gripping and welding second ends of severed tubular sections, one of said first controlled welding tongs including a resilient portion located on the surface of said first transverse welding cylinder in a position to be acted on by said heated knife;

air suction boxes positioned on the surface of said first transverse welding cylinder for holding the received tubular web of film;

pressure belts disposed adjacent and partially enveloping said welding cylinder for holding severed tubular sections on said welding cylinder;

control means for controlling supply of suction air from the source of suction air to said air suction boxes so that only the air suction boxes positioned between the position where the tubular web of film is received and the start of the pressure belts receive suction air;

a second transverse welding cylinder positioned adjacent said first transverse welding cylinder for receiving severed tubular sections from said first transverse welding cylinder;

second controlled welding tongs carried by said second transverse welding cylinder for gripping first ends of the received tubular sections;

blow nozzle means for directing first ends of the received tubular sections away from said first transverse welding cylinder and for directing the first ends towards said second transverse welding cylinder, said blow nozzle means being located beneath and radially directed toward the surface of said first transverse welding cylinder; and means for rotating said second transverse welding cylinder, said means being operatively associated with said means for rotating said first transverse welding cylinder so that the phase position of the rotary movements of said first and said second transverse welding cylinders is adjustable to accommodate different widths of severed tubular sections.

2. Apparatus according to claim 1 further comprising differential gearing or change gearing for adjusting the phase position between said first and said second transverse welding cylinders.

3. Apparatus according to claim 2 wherein the web of film contains printed matter and wherein the apparatus further comprises sensing means for scanning the web of film and for sensing the printed matter and an electric motor responsive to said sensing means for adjusting said gearing.

4. Apparatus according to claim 3 wherein the sensing means includes a photo-element for scanning the web of film.

5. Apparatus according to claim 1 wherein at least two pairs of first controlled welding tongs are carried by said first welding cylinder and wherein two air suction boxes are positioned between each pair at a spacing adjustable to correspond to the severed lengths of the tubular sections.

* * * * *